US006141518A

United States Patent [19]

Shin et al.

[11] Patent Number: 6,141,518

[45] Date of Patent: Oct. 31, 2000

[54] CARRIER RECOVERY APPARATUS OF LIQUID ELECTROPHOTOGRAPHIC PRINTER

[75] Inventors: Seong-soo Shin, Yongin; Un-ho Paik, Seongnam, both of Rep. of Korea

[73] Assignee: Samsung Electronics Co., Ltd., Kyungki-Do, Rep. of Korea

[21] Appl. No.: 09/309,787

[22] Filed: May 12, 1999

Related U.S. Application Data

[63] Continuation-in-part of application No. 09/090,932, Jun. 5, 1998, abandoned.

[30] Foreign Application Priority Data

Dec. 13, 1997 [KR] Rep. of Korea ..... 97-68569

[51] Int. Cl.[7] ..... G03G 15/10; F26B 21/06

[52] U.S. Cl. ..... 399/250; 34/77

[58] Field of Search ..... 34/77, 78, 635; 134/95.2; 399/249, 250, 251, 357, 358, 359, 360

[56] References Cited

U.S. PATENT DOCUMENTS 3,854,224 12/1974 Yamaji et al. ..... 34/77

5,552,869 9/1996 Schilli et al. ..... 399/251

5,884,640 3/1999 Fishkin et al. ..... 134/95.2

*Primary Examiner*—Arthur T. Grimley

*Assistant Examiner*—Hoang Ngo

*Attorney, Agent, or Firm*—Sughrue, Mion, Zinn, Macpeak & Seas, PLLC

[57] ABSTRACT

A carrier recovery apparatus of a liquid electrophotographic printer includes a drying roller rotating in contact with a photoreceptor belt, for absorbing a liquid carrier from the photoreceptor belt, a heating roller for heating the drying roller, in contact therewith, and evaporating the absorbed liquid carrier, a manifold surrounding the drying roller and the heating roller, for accommodating the evaporated gas carrier, a sealing blade disposed in a gap between the drying roller and the manifold, a condenser for receiving the gas carrier from the manifold and condensing the same, a supply line for supplying the gas carrier in the manifold to the condenser, and a return line for supplying again residual gas carrier which is not condensed in the condenser to the manifold, wherein the gas carrier is condensed while circulating in a closed loop formed by the manifold, the supply line, the condenser and the return line.

9 Claims, 4 Drawing Sheets

CARRIER RECOVERY APPARATUS OF LIQUID ELECTROPHOTOGRAPHIC PRINTER

This is a Continuation-In-Part of Application No. 09/090,932, filed Jun 5, 1998, now abandoned which application is incorporated herein by reference.

BACKGROUND OF THE INVENTION

1. Field of the Invention

The present invention relates to a liquid electrophotographic printer, and more particularly, to an apparatus for recovering a carrier from a photoreceptor belt.

2. Description of the Related Art

An electrophotographic printer such as a laser printer or copier is divided into a dry type printer using a powdered toner, and a liquid type printer using a developer liquid in which a toner is mixed with a liquid carrier such as NORPAR commercially available from Exxon, depending on the development method used. In both types of electrophotographic printers, an electrostatic latent image formed on a photoreceptor belt is developed by supplying toner thereto, and then an image is printed via a transfer medium.

A conventional liquid electrophotographic printer shown in FIG. 1 includes a printing unit 10 for printing a predetermined image on a feed sheet 1, and a carrier recovery apparatus 20 for removing a liquid carrier from a photoreceptor belt 14 for recovery.

The printing unit 10 includes the circulating photoreceptor belt 14 supported by a multitude of guide rollers 11, 12 and 13, laser scanning units 18*a*, 18*b*, 18*c* and 18*d* for forming an electrostatic latent image on the photoreceptor belt 14, development devices 15*a*, 15*b*, 15*c* and 15*d* for developing the electrostatic latent image by supplying a toner mixed with the liquid carrier, and a transfer roller 16 for transferring the developed image to the sheet 1. Reference numeral 17 represents a charging station for charging the photoreceptor belt 14 to a predetermined level.

The structure of the carrier recovery apparatus 20 will now be described in more detail with reference to FIG. 2. Referring to FIG. 2, in a manifold 21, a drying roller 22 is provided for absorbing the liquid carrier from the photoreceptor belt 14 while rotating in contact with the photoreceptor belt 14, and heating rollers 23 are provided for heating the drying roller 22, in contact therewith, and evaporating the absorbed carrier.

The evaporated gas carrier is accommodated within the manifold 21. Since a multitude of heat exchanging fins 21*a* are formed on the outer surface of the manifold 21, the gas carrier is condensed on the inner surface of the manifold 21 by heat exchange. The condensed carrier is collected from the inner surface of the manifold 21 to then be induced to a cartridge 26 through a first recovery tube 25.

Also, the uncondensed gas carrier of the manifold 21 is induced to a condenser 28 along a supply line 27 by the driving of a supply fan 29. Since a liquid condensed carrier 28*a* is contained in the condenser 28, the induced gas carrier is liquefied by the heat exchange with the condensed carrier 28*a*. As the gas carrier is condensed, the surface level of the condensed carrier 28*a* rises. Then, some of the carrier is recovered in the cartridge 26 through a second recovery tube 31. The gas carrier which is not condensed even in the condenser 28 is filtered via a filter 30 together with the air exhausted to the outside. Reference numeral 19 represents an exhaust line connected to the outside through the filter 30, for removing moisture from the printing unit 10. Reference numerals 32 and 33 represent a drain line and a moisture reservoir, for draining moisture from the liquid carrier 28*a* stored in the condenser 28 and storing the same, respectively.

In the conventional carrier recovery apparatus 20, since the gas carrier which is not condensed in the condenser 28 is removed by the filter 30, the lowering of the filtering capacity of the filter 30 may effuse the unfiltered gas carrier. However, since the NORPAR used as the carrier is a hazardous pollutant material, it is necessary to prevent the carrier from being effused.

SUMMARY OF THE INVENTION

To solve the above problem, it is an objective of the present invention to provide a carrier recovery apparatus of a liquid electrophotographic printer having an improved structure, by which the carrier can be suppressed from being effused.

Accordingly, to achieve the above objective, there is provided a carrier recovery apparatus of a liquid electrophotographic printer comprising: a drying roller rotating in contact with a photoreceptor belt, for absorbing a liquid carrier from the photoreceptor belt; a heating roller for heating the drying roller, in contact therewith, and evaporating the absorbed liquid carrier; a manifold surrounding the drying roller and the heating roller, for accommodating the evaporated gas carrier; a sealing blade disposed in a gap between the manifold and the drying roller to close the gap; a condenser for receiving the gas carrier from the manifold and condensing the same; a supply line for supplying the gas carrier in the manifold to the condenser; and a return line for supplying again residual gas carrier which is not condensed in the condenser to the manifold, wherein the gas carrier is condensed while circulating a closed loop formed by the manifold, the supply line, the condenser and the return line.

Also, one end of the supply line is connected to the manifold to be adjacent to the heating roller, so that the gas carrier resupplied to the manifold through the return line is drained through the supply line via the heating roller.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
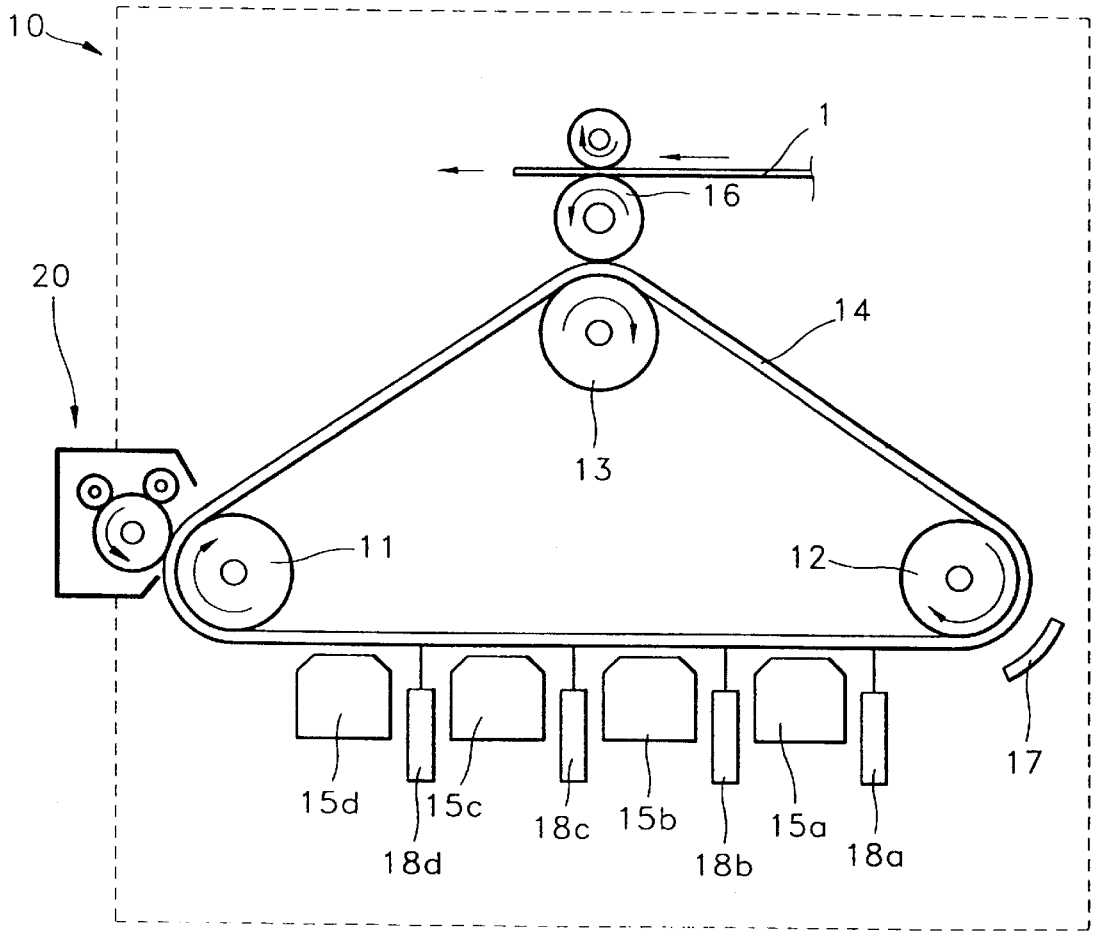
FIG. 1(PRIOR ART)
FIG. 1 is a schematic diagram of a conventional liquid electrophotographic printer.
Figure 2:
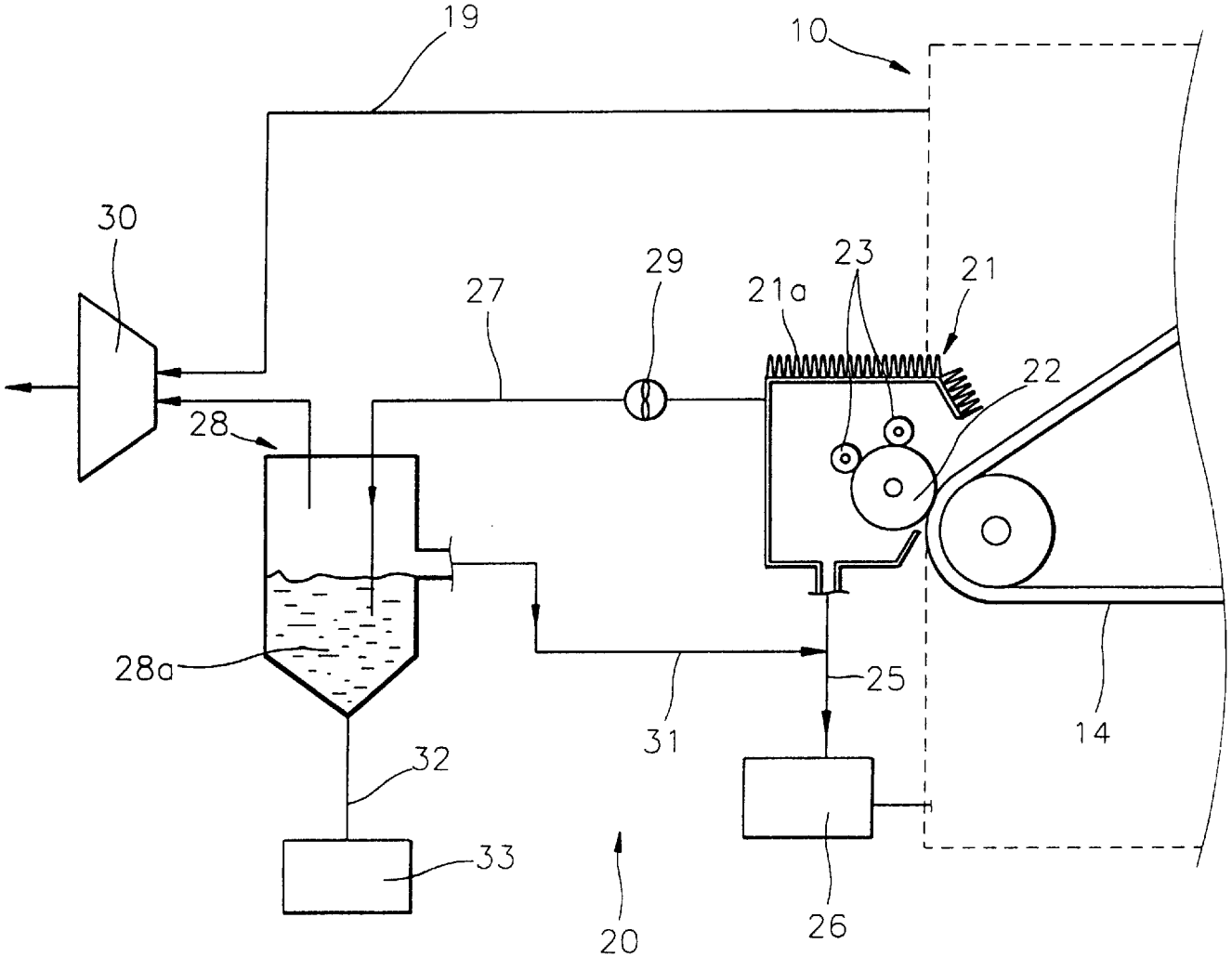
FIG. 2(PRIOR ART)
FIG. 2 is a schematic diagram of a conventional carrier recovery apparatus of the printer shown in FIG. 1.
Figure 3:
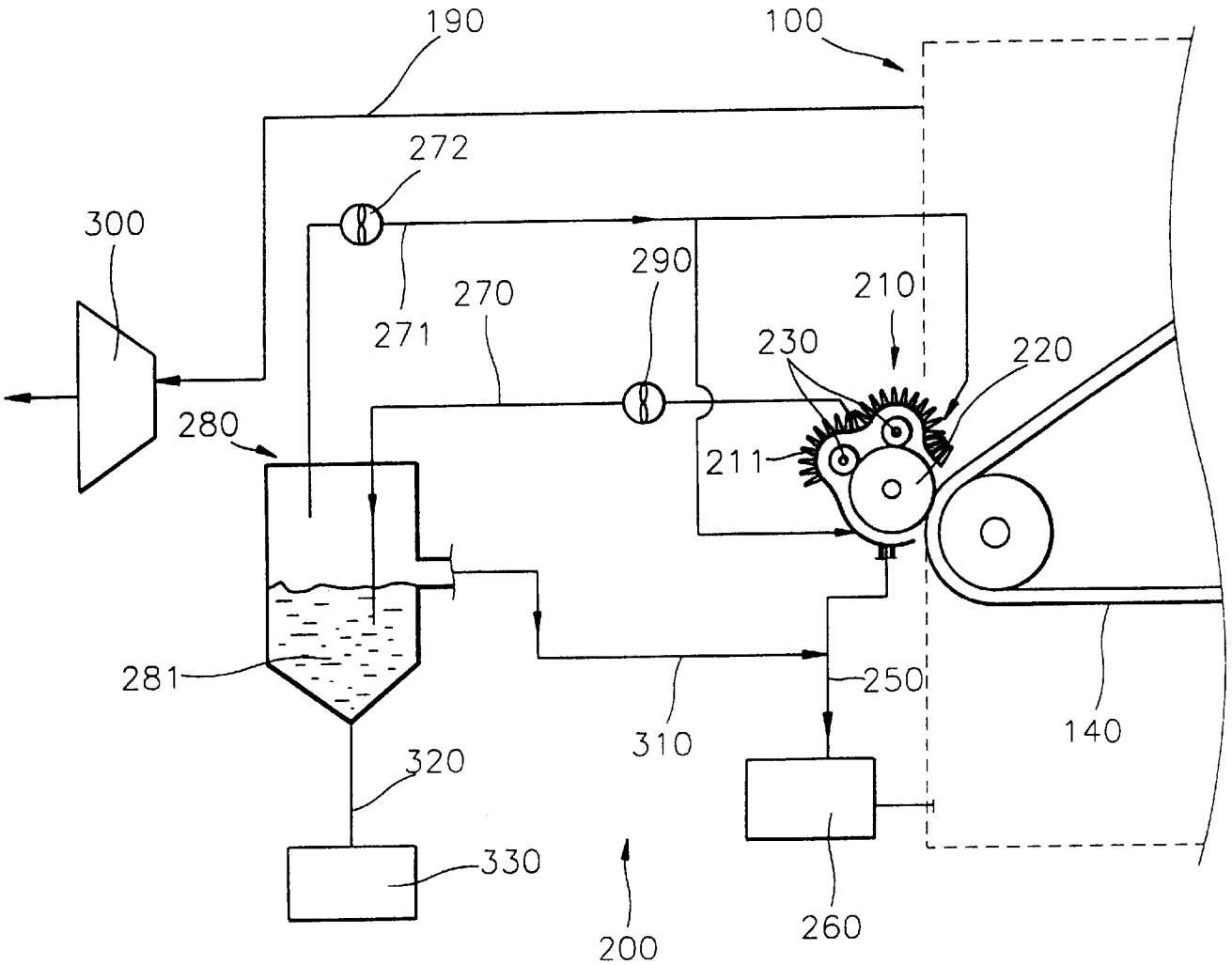
FIG. 3 is a schematic diagram of a carrier recovery apparatus according to the present invention.

A carrier recovery apparatus of a liquid electrophotographic printer according to the present invention, shown in FIG. 3, includes a drying roller 220 for absorbing the liquid carrier from a photoreceptor belt 140, and heating rollers 230 for heating the drying roller 220, in contact therewith, and evaporating the absorbed liquid carrier, both being rotatably installed in a manifold 210.

Since a multitude of heat exchanging fins 211 are formed on the outer surface of the manifold 210, some of the evaporated gas carrier is condensed on the inner surface of the manifold 210 by heat exchange with the ambient air through the heat exchanging fins 211. The condensed carrier is collected from the inner surface of the manifold 210 to then be induced to a cartridge 260 through a first recovery tube 250.

The manifold 210 is connected to a condenser 280 through a supply line 270. The carrier evaporated from the manifold 210 is supplied to the condenser 280 by the driving of a supply fan 290.

According to the present invention, the condenser 280 and the manifold 210 are connected to each other through a return line 271. The return line 271 again supplies a small amount of the gas carrier which is not condensed in the condenser 280 to the manifold 210 by the driving of a return fan 272. Thus, the manifold 210 and the condenser 280 form a closed loop along which the gas carrier circulates by the supply line 270 and return line 271. Here, the return line 271 branches off in two paths, as shown in FIG. 3, to then be connected to the manifold 210. One end of the supply line 270 is preferably connected to the manifold 210 adjacent to the heating rollers 230, so that the gas carrier resupplied to the manifold 210 is removed through the supply line 270 via the heating roller 230.

If the surface level of the liquid carrier condensed in the condenser 280 rises, the carrier moves toward a cartridge 260 through a second recovery tube 310. Reference numeral 190 represents an exhaust line connected to a filter 300, for removing moisture from a printing unit 100. Reference numerals 320 and 330 represent a drain line and a moisture reservoir, for draining moisture from the liquid carrier condensed in the condenser 280 and storing the same, respectively.

In the aforementioned carrier recovery apparatus according to present invention, the liquid carrier absorbed from the photoreceptor belt 140 to the drying roller 220 is evaporated by the heating roller 230 and then is accommodated in the manifold 210.

Also, the evaporated gas carrier moves to the condenser 280 along the supply line 270 by the driving of the supply fan 290 and most of the carrier is condensed by the heat exchange with the liquid carrier 281 to then be liquefied. A negligible amount of uncondensed gas carrier returns to the manifold 210 along the return line 271.

Therefore, the gas carrier is condensed while continuously circulating between the manifold 210 and the condenser 280, and is recovered in the cartridge 260. The moisture contained in the liquid carrier is drained to the moisture reservoir 330.

Figure 4:
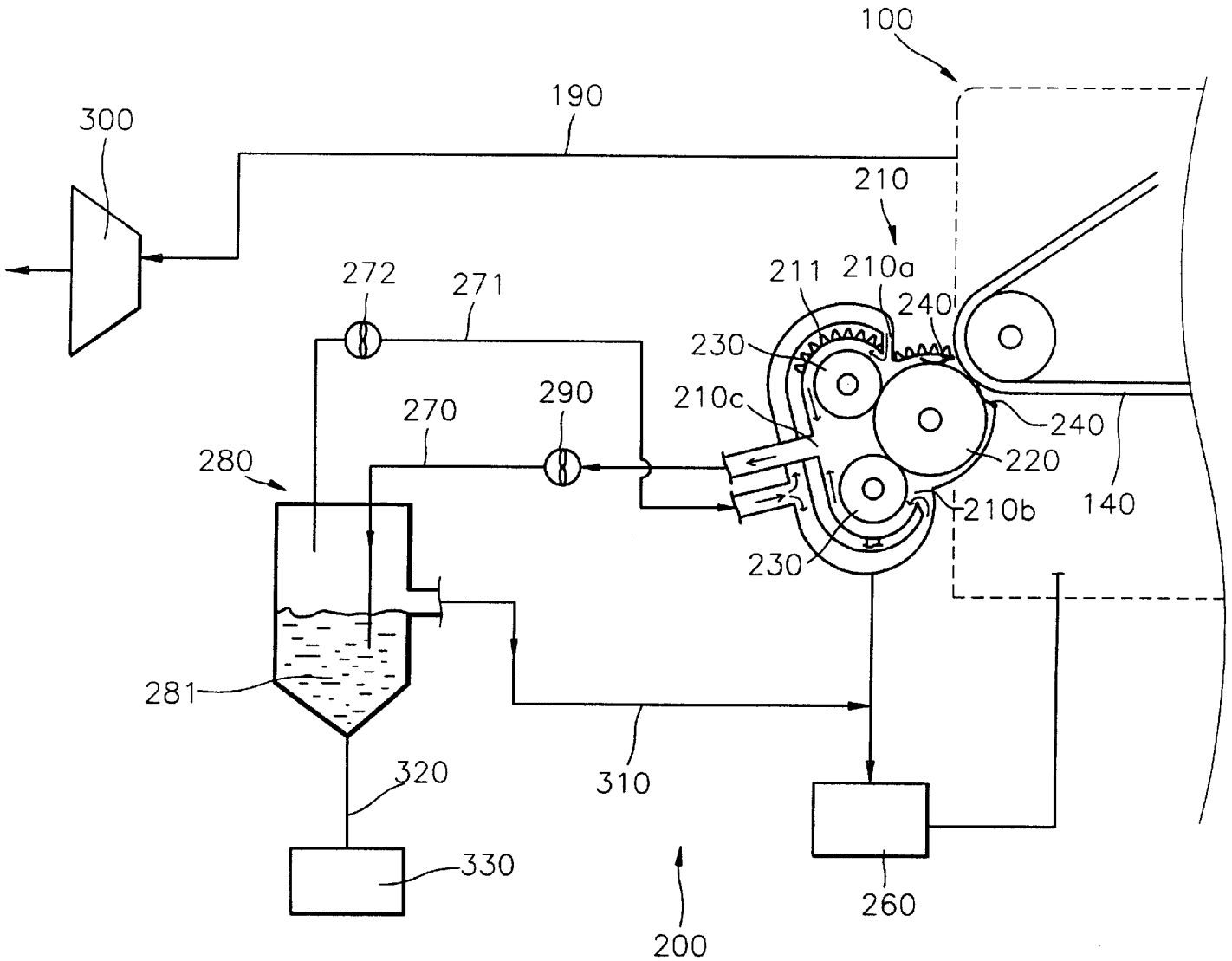
FIG. 4 is a schematic diagram of a further embodiment of the present invention.

A further embodiment of the invention is illustrated in FIG. 4. The carrier recovery apparatus has a similar structure to the first embodiment. In this further embodiment, however, at least one sealing blade 240 is added to the carrier recovery apparatus to further improve the closed loop system.

Specifically, the sealing blade 240 is disposed at the manifold 210 for sealing the inside of the manifold 210 to prevent the inflow of open air through a gap between the manifold 210 and the drying roller 220. The sealing of the manifold by the sealing blade 240 also functions to improve the suction efficiency of the supply fan 290.

The sealing blades 240, in FIG. 4, contact the drying roller 220 at a point immediately before the drying 220 roller contacts the belt 140, and at a point immediately after the drying roller 220 touches the belt 140. In a preferred embodiment, the sealing blades 240 are made of urethane and have a thickness of 0.1 to 0.2 mm.

Thus, with the sealing blades 240 in FIG. 4, the manifold 210 has no open portions except for inlets 210*a*, 210*b* and outlet 210*c*. The inlets 210*a*, 210*b* connect the return line 271 to the manifold 210, while the outlet 210*c* connects the manifold to the supply line 270.

As described above, the carrier recovery apparatus of a liquid electrophotographic printer according to the present invention is constructed such that a manifold and a condenser for evaporating and condensing a carrier, respectively, are connected to each other to form a closed loop, thereby enhancing the carrier recovery efficiency.

What is claimed is:

1. A carrier recovery apparatus of a liquid electrophotographic printer, comprising:

a drying roller rotating in contact with a photoreceptor belt, for absorbing a liquid carrier from the photoreceptor belt;

a heating roller contacting said drying roller for heating said drying roller and evaporating the liquid carrier absorbed by said drying roller;

a manifold surrounding said drying roller and said heating roller, for accommodating evaporated gas carrier;

a sealing blade disposed in a gap between said drying roller and said manifold to close the gap;

a condenser for receiving the evaporated gas carrier from said manifold and condensing the evaporated gas carrier;

a supply line for supplying the evaporated gas carrier in said manifold to said condenser; and a return line for returning the evaporated gas carrier which is not condensed in said condenser to said manifold, wherein the evaporated gas carrier is condensed while circulating in a closed loop formed by said manifold, said supply line, said condenser and said return line.

2. The carrier recovery apparatus according to claim 1, wherein one end of said supply line is connected to said manifold adjacent to said heating roller, so that the evaporated gas carrier returned to said manifold through said return line is drained from said manifold through said supply line via said heating roller.

3. The carrier recovery apparatus according to claim 1, wherein said return line branches off in two paths that communicate with different portions of said manifold.

4. The carrier recovery apparatus according to claim 1, further comprising a return fan for said return line for drawing the evaporated gas carrier which is not condensed in said condenser from said condenser to said manifold.

5. The carrier recovery apparatus according to claim 1, wherein said sealing blade is made of urethane.

6. The carrier recovery apparatus according to claim 1, wherein said sealing blade has a thickness between 0.1–0.2 mm.

7. The carrier recovery apparatus according to claim 1, wherein said manifold includes an inlet for connecting said return line to said manifold, and an outlet for connecting said manifold to said supply line, and wherein the only openings of said manifold are said inlet and outlet.

8. The carrier recovery apparatus according to claim 1, wherein said sealing blade is mounted on said manifold and is biased against said drying roller.

9. The carrier recovery apparatus according to claim 1, wherein there are two sealing blades, one of said sealing blades being disposed on one side of said drying roller, and the other one of said sealing blades being disposed on another side of said drying roller.

* * * * *